United States Patent [19]

Hsu et al.

[11] Patent Number: 5,048,546

[45] Date of Patent: Sep. 17, 1991

[54] FILTER AND METHOD OF TREATING TOBACCO SMOKE TO REDUCE MATERIALS HARMFUL TO HEALTH

[76] Inventors: Chi-Hsueh Hsu, 4 F, No. 144, Chu Lin Rd., Yung Ho, Taipei; Wen Li Yang, No. 92-1, Pai Ma Chuang, Chung Li; Shien-Yu Chuang, No. 57, Lane 20, Chih Yu Rd., Sec. 2, Shih Lin District, Taipei, all of Taiwan; David Yue-Weilee, 105 Highland Dr., Chapel Hill, N.C. 27514

[21] Appl. No.: 450,310

[22] Filed: Dec. 15, 1989

[51] Int. Cl.[5] ..... A24D 3/06

[52] U.S. Cl. ..... 131/331; 131/342; 131/344

[58] Field of Search ..... 131/275, 331, 332, 375, 131/342, 344

[56] References Cited

U.S. PATENT DOCUMENTS 52,976 3/1866 Dawson ..... 131/275
172,095 1/1876 Dickerson ..... 131/275

FOREIGN PATENT DOCUMENTS 1437830 3/1966 France .
1103823 2/1968 United Kingdom .

*Primary Examiner*—V. Millin
*Attorney, Agent, or Firm*—Browdy and Neimark

[57] ABSTRACT

A method for treating nicotine containing materials such as tobacco, tobacco smoke and tobacco extracts involves adding to an adsorptional filter material postassium aluminum sulfate, $KAl(SO_4)_2$, commonly known as alum, in a quantity of 10 to 200 mg per cigarette, which additive is capable of chemical binding of nicotine and other toxic materials in the tobacco smoke.

18 Claims, 2 Drawing Sheets

FILTER AND METHOD OF TREATING TOBACCO SMOKE TO REDUCE MATERIALS HARMFUL TO HEALTH

FIELD OF INVENTION

The present invention relates to personal and public health, and more particularly to the elimination of nicotine and other harmful materials from tobacco smoke.

BACKGROUND OF THE INVENTION

The inhalation of smoke generated from combustion of tobacco and tobacco substitute is known to be health hazard.

The removal of harmful or potentially harmful constituents from tobacco smoke has been the subject of extensive research efforts. Several methods have been employed to either bind or destroy harmful constituents by passing the tobacco smoke through a treated filter or by incorporating in the tobacco certain substances which are capable of reducing the harmful components in tobacco smoke such as carbon monoxide, hydrogen cyanide, formaldehyde, acrolein, nicotine, phenols, tars, polycyclic hydrocarbons and other toxic components.

There are many procedures which serve the purpose of filtering tobacco smoke. The best commercial cigarette filters, known as "multifilters", basically take advantage of special varieties of materials which adsorb or retain a given portion of the harmful or potentially harmful components of tobacco smoke. For instance, Phillip Morris produces a "multifilter" which consists of a black cellulose acetate base covered with a specified amount and quality of activated charcoal. This section of filter is closed with a white cellulose acetate cover filter at the sucking end of the cigarette (see FIG. 1-A). A filter arrangement shown in FIG. 1-B is also well known, in which two cylinder-shaped filters of either the same or different materials are spaced by 3 to 5 mm apart, the interspace being then filled with adsorbents of granular structure, mostly charcoal or silicates, or mixtures thereof.

A number of substances capable of reducing the harmful components of tobacco smoke have been applied to the cigarette filter. For instance, U.S. Pat. No. 4,753,250 (1988) describes a process for producing cigarette filter comprising L-ascorbic acid (Vitamin C), which is capable of chemically binding formaldehyde in the cigarette smoke,; U.S. Pat. No. 4,414,988 (1983) discloses a tobacco filter containing an aqueous solution of ferric ion binding protoporphyrin ring structure as a removal agent for carcinogenic substances in tobacco smoke; U.S. Pat. No. 3,664,352 (1972) describes a filter containing a water insoluble mixed-metal carbonate of an alkaline earth metal which is capable of removing hydrogen cyanide from tobacco smoke; U.S. Pat. No. 3,943,940 describes a method of removing nicotine by adding potassium permanganate to the cigarette filter; U.S. Pat. No. 3,110,315 (1963) discloses a method of employing tannic acid and its ester to remove nicotine from tobacco smoke. Other methods of making cigarettes with reduced harmful components include adding to the cigarette paper calcium sulfamate (U.S. Pat. No. 3,782,393; 1974), or incorporating a catalytic amount of transition metal compound into the tobacco (U.S. Pat. No. 4,125,118).

In spite of these efforts which have apparently not been adopted successfully in the industry, recently there has been escalating public awareness and governmental concern with respect to the health hazards associated with the cigarette smoking.

SUMMARY OF THE INVENTION

Accordingly, it is an object of the present to overcome deficiencies in the prior art, such as indicated above.

It is a further object of the present invention to provide improved means for reducing harmful components in tobacco smoke.

It is another object of the present invention to remove substantial amount of nicotine and tars from cigarette smoke.

It is yet another object of the present invention to provide a filter containing a substance or a mixture of components which will effectively reduce the harmful components passing through such filter elements.

It is yet a further object of the present invention to provide a method of treating the cigarette paper or tobacco with an agent for reducing the harmful components in-tobacco smoke.

Other objects and the nature and advantages of the present invention will become apparent from the accompanying description and examples.

DESCRIPTION OF EMBODIMENTS

Figure 1A:
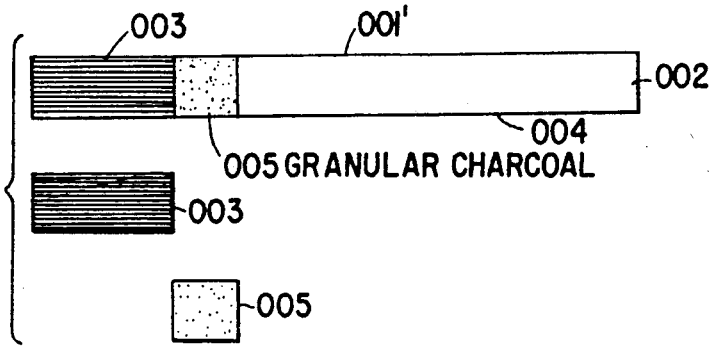
FIG. 1A. PRIOR ART
FIGS. 1A, 1B and 1C illustrate conventional cigarette/cigarette filter constructions of the prior art, which constructions can also be used in accordance with the present invention.
Figure 1B:
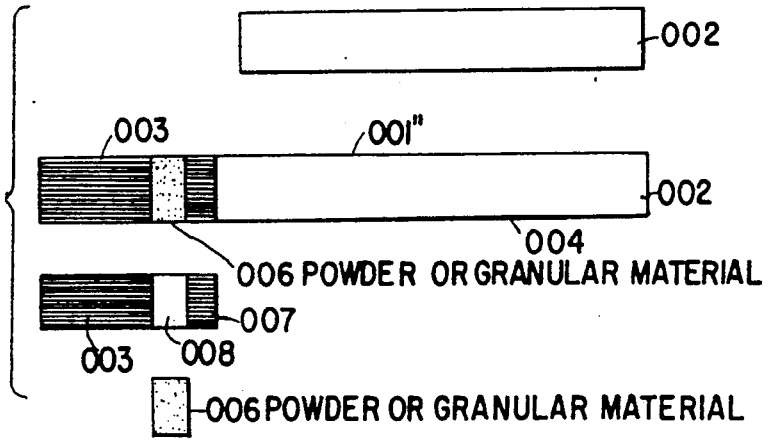
FIG. 1B. PRIOR ART
Figure 1C:
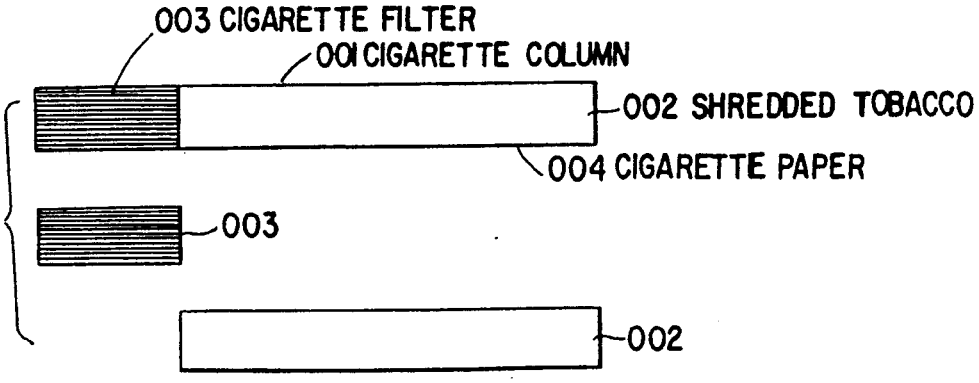
FIG. 1C. PRIOR ART

FIG. 1C shows a conventional filter cigarette 001 comprising a cigarette paper tube 004 containing shredded tobacco 002 and a cigarette filter 003 at one end thereof. In accordance with the present invention, any or all three portions of the cigarette 001 may be impregnated or coated with alum in order to achieve the objectives of the present invention.

FIGS. 1A and 1B show similar conventional structures, the cigarette 001' of FIG. 1A also having a granular charcoal filter portion 005, the granular charcoal being located between the main filter portion 003 and the shredded tobacco portion 002. According to FIG. 1B, the cigarette 001" is further provided with a second filter section 007, there being a gap 008 between the filter sections 003 and 007 into which powdered or granular material 006, such as charcoal or silicates, is normally placed.

All of these constructions of the prior art can be used in conjunction with the present invention, wherein powdered or granular alum is substituted for the granular charcoal or intermixed with the granular charcoal.

In accordance with the above noted objects, the present invention contemplates a method of treating tobacco smoke to reduce the harmful components therein which comprises contacting the tobacco smoke with "Alum". The term "Alum" is used herein broadly, so as to include hydrated and dehydrated forms of potassium aluminum sulfate and various other forms. Alum has the general formula of $M^{I}M^{II}(SO_4)_2.x\ H_2O$, in which $M^{I}$ is univalent metal ion and may be Na, K, Rb, Cs, $NH_4$, Tl, Ag or quaternary organic base (e.g. $NMe_4$); $M^{II}$ is trivalent metal ions and may be Al, Fe, Cr, Mn, In, Tl, Ga, V, Co, Ti, Rh, etc. and $SeO_4$ or $TeO_4$ may replace SO4, and x is an integer having a value of 0, 12 and 24. Surprisingly, it has now been found that alum, preferably potassium aluminum sulfate, is capable of complexing with nicotine and tars effectively. This means that besides the mechanical and absorptional filtering provided, there also exists the chemocomplexing function which is a key aspect of the present invention.

In this filtering and complexing procedure, a great percentage of the harmful components, especially nicotine from the cigarette smoke, is retained by chemical binding thus preventing these harmful substances from getting into the human organism. A major advantage of the present invention is that a safe substance, alum, commonly used in home pickling and baking, is employed for reducing the harmful components in the tobacco smoke.

The quantity of alum used will of course vary depending on the quantity of tobacco to be burned. For a conventional sized cigarettes, however, it has been found that a quantity of 10–200 mg. is effective to achieve the purposes of the present invention.

The alum may be utilized in accordance with the present invention in a number of ways in addition to those pointed out above. Thus, the alum can be dissolved in a suitable vehicle such as water or alcohol and impregnated into the filter, the cigarette paper or into the tobacco itself in such a quantity, preferably 10–200 mg. for a normal sized cigarette, to achieve the objectives of the present invention; normally, the alum solution will contain 10–25% alum.

Further in accordance with the invention, and especially where the alum is used in powder or granular form as part of the filter, the alum may be intermixed with other materials including granular carbon and/or various organic acids such as L-ascorbic acid, tannic acid, oxalic acid, tartaric acid and salicylic acid, in varying ratios, it being understood that for a normal size cigarette there should still be a minimum of about 10 mg. of alum present. A preferred ratio is 1 part of alum to 1 part of carbon particles. When an organic acid is present, the ratio is preferably 1 part of alum to 1 part of organic acid; and when both an organic acid and carbon granules are present, the ratio should preferably be about 1:1:1.

The following examples illustrate the process of the invention:

EXAMPLE 1

Alum in powder or granular form is applied on a vehicle of fibrous paper or cellulose acetate, preferably, in the quantity of 10 to 200 mg per cigarette, then procedure is continued in known manner.

EXAMPLE 2

Figure 2A:
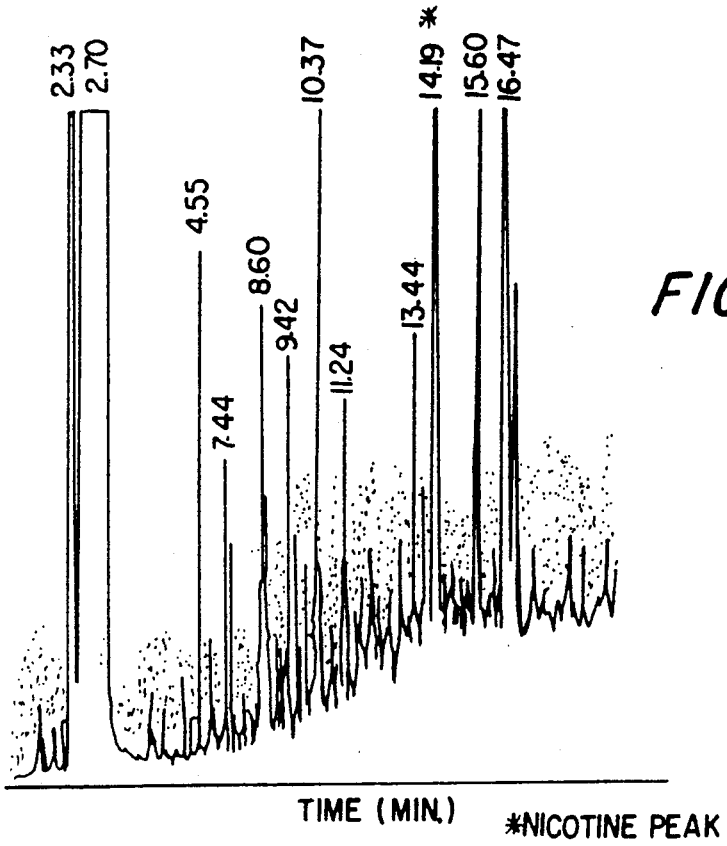
FIGS. 2A and 2B are comparative gas chromatograms, FIG. 2A showing such a gas chromatogram using a conventional charcoal filter of the prior art, and FIG. 2B showing a gas chromatogram of an otherwise similar filter cigarette incorporating alum in accordance with the present invention.
Figure 2B:
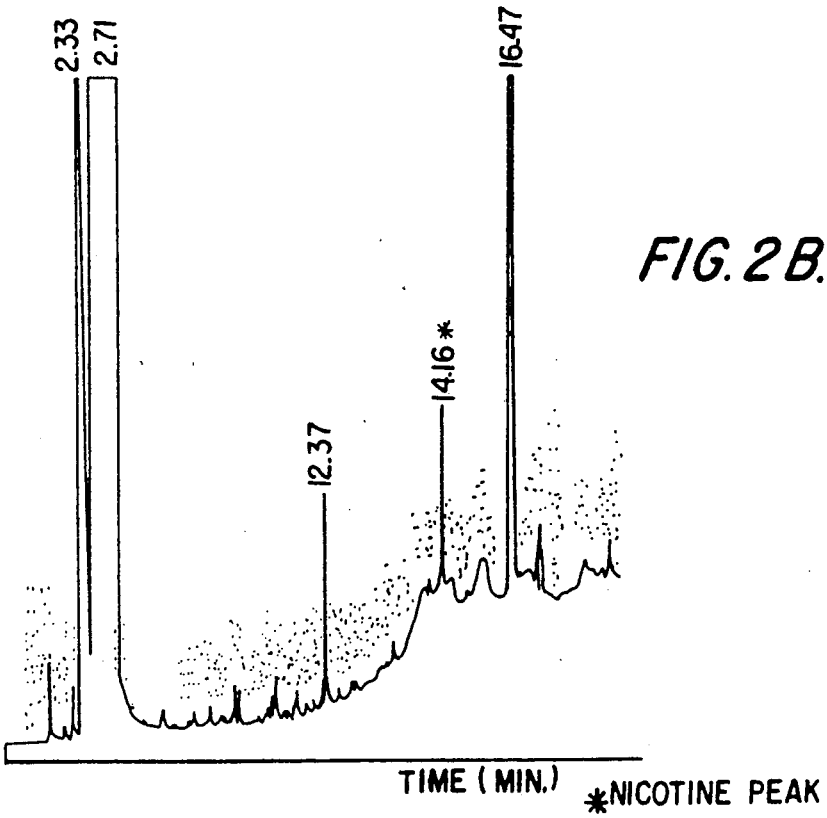

Two hundred mg. of granular alum was filled into the cylindrical gap 008 of 5 mm length of a filter construction as shown in FIG. 1B, and this section of the filter was closed with a white cellulose acetate cover filter 003 at the sucking end of cigarette. The cigarette so produced was then "smoked" and the products of combustion, i.e. the "smoke" was analyzed by gas chromatography, the results being shown in FIG. 2B. An otherwise identical cigarette but having a charcoal filter instead of the alum filter was comparatively tested, and the gas chromatogram of the products of combustion is shown in FIG. 2A.

This comparative test shows that a cigarette filter containing ca. 200 mg by weight of alum is capable of removing nicotine and tars significantly, ca. by 80 to 95 percent depending on the preparation of the filter. In contrast, normal filter containing charcoal can only remove 40% of nicotine according to experiments. The binding of nicotine from cigarette smoke with alum is further evidenced by analysis of the chloroform extract of the complex. The result of this analysis showed that nicotine is selectively bind with alum.

EXAMPLE 3

A solution of alum, preferably a 10 to 25 percent solution is applied onto fibrous filter paper or cellulose acetate, providing a quantity of 10 to 200 mg of dry alum per cigarette. The filter is dried and the procedure is continues in known manner.

EXAMPLE 4

In the way specified in example 3, a solution of alum, preferably a 10 to 25 percent solution is applied onto cigarette paper giving a quantity of 10 to 200 mg dry alum per cigarette. The cigarette paper is dried, rolled into rod shape following the known procedure of cigarette making.

EXAMPLE 5

Powder or granular alum is mixed thoroughly with cut tobacco in the quantity of 10 to 200 mg per cigarette. The tobacco is rolled into rod shape and the procedure is continued in known manner.

EXAMPLE 6

In the way specified in examples 1 to 5, a mixture of substances consisting of alum, charcoal is employed as the filtering elements and the procedure is continued in known manner.

EXAMPLE 7

In the way specified in example 1 to 4, a mixture of substances consisting of alum, charcoal and L-ascorbic acid (vitamin C) is employed as the filtering elements. The L-ascorbic acid can also be replaced by other organic acid such as tannic acid, oxalic acid, tartaric acid and salicylic acid. The mixture is preferably in a 1:1:1 ratio and in a total quantity of 100 to 200 mg per cigarette.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A method of treating tobacco smoke to reduce the amount of harmful components therein, comprising contacting tobacco smoke with "Alum" which is applied to filtering material, cigarette paper or tobacco in an amount sufficient to remove at least about 80% of nicotine present in said tobacco smoke, said sufficient amount being at least 10 mg. of alum per cigarette, said "Alum" having the formula:

$$M^{I}M^{II}(SO_4)_2.xH_2O$$

wherein $M^{I}$ is a univalent metal ion and may be Na, K, Rb, Cs, $NH_4$, T1, Ag or a quaternary organic base (e.g. $NMe_4$); $M^{II}$ is a trivalent metal ion and may be Fe, Cr, Al, Mn, In, T1, Ga, V, Co, Ti, Rh, etc., and $SeO_4$ or $TeO_4$ may replace SO4; and x is an integer having a value of 0, 12 or 24.

2. A method according to claim 1, comprising treating a nicotine containing material selected from the group consisting of tobacco, tobacco smoke and tobacco extracts, wherein $M^{I}$ is K, $M^{II}$ is Al and x is 0 or 12.

3. A method according to claim 1 wherein said alum is in a filter element.

4. A method of treating tobacco smoke to reduce the amount of harmful components therein, comprising contacting tobacco smoke with "Alum" which is applied to filtering material, cigarette paper or tobacco in a quantity of 10 to 200 mg per cigarette, said "Alum" having the formula:

$$M^{I}M^{II}(SO_4)_2.x\ H_2O$$

wherein $M^{I}$ is a univalent metal ion and may be Na, K, Rb, Cs, $Nh_4$, T1, Ag or a quaternary organic base (e.g. $NMe_4$); $M^{II}$ is a trivalent metal ion and may be Fe, Cr, Al, Mn, In, T1, Ga, V, Co, Ti, Rh, etc., and $SeO_4$ or $TeO_4$ may replace SO4; x is an integer having a value of 1, 12 or 24, and wherein said alum is in a filter element, and wherein said filter element in the form of two cylindrical filters spaced 3 to 5 mm apart to form a gap, and said alum is filled into the gap in a quantity of 10 to 200 mg.

5. A method of treating tobacco smoke to reduce the amount of harmful components therein, comprising contacting tobacco smoke with "Alum" which is applied to filtering material, cigarette paper or tobacco in a quantity of 10 to 200 mg per cigarette, said "Alum" having the formula:

$$M^{I}M^{II}(SO_4)_2.x\ H_2O$$

wherein $M^{I}$ is a univalent metal ion and may be Na, K, Rb, Cs, $NH_4$, T1, Ag or a quaternary organic base (e.g. $NMe_4$); $M^{II}$ is trivalent metal ions and may be Fe, Cr, Al, Mn, In, T1, Ga, V, Co, Ti, Rh, etc., and $SeO_4$ or $TeO_4$ may replace SO4; and x is an integer having a value of 0, 12 or 24, and wherein said filtering material is impregnated with 10 to 25 percent solution of said alum.

6. A method according to claim 5 wherein said alum is potassium aluminum sulfate.

7. A method of treating tobacco smoke to reduce the amount of harmful components therein, comprising contacting tobacco smoke with "Alum" which is applied to filtering material, cigarette paper or tobacco in a quantity of 10 to 200 mg per cigarette, said "Alum" having the formula:

$$M^{I}M^{II}(SO_4)_2.x\ H_2O$$

wherein $M^{I}$ is a univalent metal ion and may be Na, , Rb, Cs, $NH_4$, T1, Ag or a quaternary organic base (e.g. $NMe_4$); $M^{II}$ is a trivalent metal ion and may be Fe, Cr, Al, Mn, In, T1, Ga, V, Co, Ti, Rh, etc., and $SeO_4$ or $TeO_4$ may replace SO4; and x is an integer having a value of 0, 12 or 24, and wherein said cigarette paper is impregnated with 10 to 25 percent solution of said alum.

8. A method according to claim 7 wherein said alum is potassium aluminum sulfate.

9. A method of treating tobacco smoke to reduce the amount of harmful components therein, comprising contacting tobacco smoke with "Alum" which is applied to filtering material, cigarette paper or tobacco in a quantity of 10 to 200 mg per cigarette, said "Alum" having the formula:

$$M^{I}M^{II}(SI_4)_2.x\ H_2O$$

wherein $M^{I}$ is a univalent metal ion and may be Na, K, Rb, Cs, $NH_4$, T1, Ag or a quaternary organic base (e.g. $NMe_4$); $M^{II}$ is a trivalent metal ion and may be Fe, Cr, Al, Mn, IN, T1, Ga, V, Co, Ti, Rh, etc., and $SeO_4$ or $TeO_4$ may replace SO4; and x is an integer having a value of 0, 12 or 24, and wherein said tobacco is impregnated with said alum.

10. A method according to claim 9 wherein said alum is potassium aluminum sulfate.

11. A method of treating tobacco smoke to reduce the amount of harmful components therein, comprising contacting tobacco smoke with "Alum" which is applied to filtering material, cigarette paper or tobacco in a quantity of 10 to 200 mg per cigarette, said "Alum" having the formula:

$$M^{I}M^{II}(SO_4)_2.x\ H_2O$$

wherein $M^{I}$ is a univalent metal ion and may be Na, K, Rb, Cs, $NH_4$, T1, Ag or a quaternary organic base (e.g. $NMe_4$); $M^{II}$ is a trivalent metal ion and may be Fe, Cr, Al, Mn, In, T1, Ga, V, Co, Ti, Rh, etc., and $SeO_4$ or $TeO_4$ may replaces SO4; and x is an integer having a value of 0, 12 or 24, and mixing said alum with charcoal in a ratio of about 1 to 1 and making a cigarette filter therefrom.

12. A method of treating tobacco smoke to reduce the amount of harmful components therein, comprising contacting tobacco smoke with "Alum" which is applied to filtering material, cigarette paper or tobacco in a quantity of 10 to b 200 mg per cigarette, said "Alum" having the formula:

$$M^{I}M^{II}(SO_4)_2.x\ H_2O$$

wherein $M^{I}$ is a univalent metal ion and may be Na, K, Rb, Cs, $NH_4$, T1 Ag or a quaternary organic base (e.g. NMe$); $M^{II}$ is a trivalent metal ion and may be Fe, Cr, Al, Mn, In, T1, Ga, V, Co, Ti, Rh, etc., and $SeO_4$ or $TeO_4$ may replace SO4; and x is an integer having a value of 0, 12 or 24, and adding an organic acid selected from the group consisting of L-ascorbic acid, tannic acid, oxalic acid, tartaric acid and salicylic acid to said alum in a ratio of about 1 part of alum to 1 part of organic acid.

13. A method according to claim 12 further comprising about 1 part of carbon particles per part of alum.

14. A filter construction for use in the consumption of smoking tobacco, comprising a filter structure and an amount of alum sufficient to remove at least about 80% of nicotine present in nicotine-containing tobacco smoke upon passage of said tobacco smoke through said filter, said amount of alum being at least 10–200 mg.

15. A filter construction according to claim 14 wherein said alum is potassium aluminum sulfate.

16. A filter construction in accordance with claim 14 wherein said alum is mixed with charcoal in a ratio of about 1 to 1.

17. A filter construction according to claim 14 wherein said alum is mixed with an organic acid selected from the group consisting of L-ascorbic acid, tannic acid, oxalic acid, tartaric acid and salicylic acid in a ratio with said alum of about 1 part of alum to 1 part of organic acid.

18. A filter construction for use in the consumption of smoking tobacco in the form of two cylindrical filters spaced 3–5 mm part to form a gap, said gap containing alum in a quantity of 10–200 mg.

* * * * *